United States Patent [19]

Sasnett, Jr. et al.

[11] 3,994,419

[45] Nov. 30, 1976

[54] REMOTE CONTROL FLUID DISPENSING SYSTEM

[75] Inventors: Bolling H. Sasnett, Jr.; Rutherford L. Ellis, Jr., both of Atlanta, Ga.

[73] Assignee: EPSCO, Incorporated, Atlanta, Ga.

[22] Filed: Oct. 30, 1975

[21] Appl. No.: 627,093

[52] U.S. Cl. ..... 222/26; 222/27; 222/33; 222/76; 235/92 FL

[51] Int. Cl.[2] ..... B67D 5/06; B67D 5/08

[58] Field of Search ..... 222/23, 25–28, 222/30, 32–38, 76; 340/184, 310 R; 235/92 FL, 151.34

[56] References Cited

UNITED STATES PATENTS 3,894,658 7/1975 Buell ..... 222/27

*Primary Examiner*—Allen N. Knowles

[57] ABSTRACT

A remote control fluid dispensing system is disclosed comprising a fluid dispenser and electrical pump means for pumping fluid from the dispenser at a dispensing station. Pulse generating means are provided at the dispensing station for generating DC pulses in metered response to the dispensing of fluid. Electrical to light energy transducer means and light to electrical energy transducer means electrically insulated from but optically coupled with the electrical to energy transducer means are provided at a control station. Electrical circuit means are further provided for coupling the pulse generating means with the electrical to light energy transducer means and for coupling the electrical pump means with a source of current at the control station. Display means are further provided at the control station coupled with the light to electrical energy transducer means for displaying metered dispensing of fluid information generated by the pulse generating means.

8 Claims, 4 Drawing Figures

REMOTE CONTROL FLUID DISPENSING SYSTEM

BACKGROUND OF THE INVENTION

This invention relates generally to remote control fluid dispensing systems, and particularly to remote control fluid dispensing systems of the type adapted to control and display metered dispensing of fuel such as gasoline at a control station located remotely from a fuel dispensing station.

Heretofore, remote control fluid dispensing systems, such as that disclosed in U.S. Pat. No. 3,771,697, have typically employed electromechanical displays at a control station energized by electrical pulsing means mechanically coupled with the fluid dispenser at the dispensing station. The pulsing means has been powered by the AC voltage provided at the dispensing station for driving the dispenser pump. Though such systems have functioned satisfactorily for a time, they have had only marginal reliability over extended periods of time due to the presence of electromechanical type of read-outs. The fact that 60 cps voltage has driven the pulsing means has also served to limit the speed at which the dispensing of fluid may be accurately metered. As the price of fuel increases the speed at which price metering is required also increases. Recently, the prices of some fuels have risen to a point approaching the limits of 60 cps voltage counters.

Other remote control fluid dispensing systems, such as that disclosed in U.S. Pat. No. 3,523,627, have utilized DC pulse generating means at the dispensing station coupled with Nixie tube type read-outs or displays at the control station. Though the response time of such systems is greatly enhanced by the DC pulsers, it has been necessary to rewire the pumps in order to isolate the DC metering system voltages from the AC pumping system voltages. This has necessitated such reconstruction work as breaking up concrete roadways, laying separate conduit, and then resurfacing the area. This approach is obviously expensive and highly inconvenient to the conduct of business. Without circuit isolation, however, potentially dangerous AC voltage could appear at the control console within the control station in the event of a malfunction and shorting of the two electrical systems.

Accordingly, it is a general object of the present invention to provide an improved remote control fluid dispensing system.

More specifically, it is an object of the present invention to provide a remote control fluid dispensing system having an electrical metering system electrically isolated from an electrical pumping system.

Another object of the invention is to provide a system of the type described which may be incorporated into preconstructed systems using AC voltages for both metering and pumping without substantial rewiring of the circuits coupling the control station with the dispensing stations.

Yet another object of the invention is to provide a system of the type described which is highly reliable in operation over extended periods of time.

SUMMARY OF THE INVENTION

In one form of the invention a remote control fluid dispensing system is provided comprising a fluid dispenser and electrical pump means for pumping fluid from the dispenser at a dispensing station. Pulse generating means are provided at the dispensing station for generating DC pulses in metered response to the dispensing of fluid. Electrical to light energy transducer means and light to electrical energy transducer means electrically insulated from but optically coupled with the electrical to light energy transducer means are provided at a control station. Electrical circuit means are further provided for coupling the pulse generating means with the electrical to light energy transducer means and for coupling the electrical pump means with a source of current at the control station. Display means are further provided at the control station coupled with the light to electrical energy transducer means for displaying metered dispensing of fluid information generated by the pulse generating means.

DESCRIPTION OF THE PREFERRED EMBODIMENT

Figure 1:
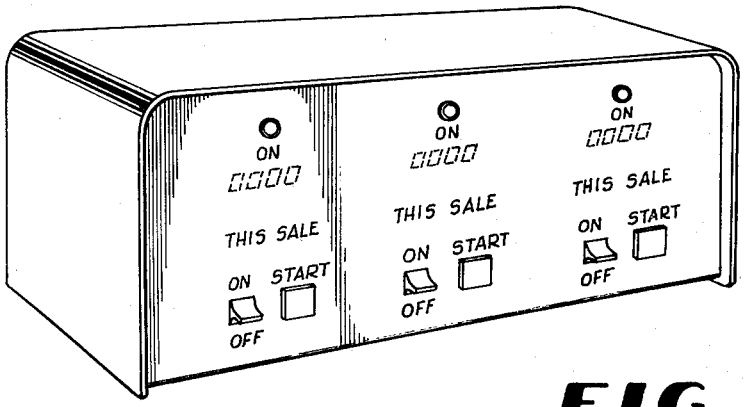
FIG. 1 is a perspective view of a control and display console for a three gasoline pump dispensing station adapted for use with a system of the present invention.

In FIG. 1 a console is illustrated for controlling and displaying the sale of gasoline by three pumps located remotely from the console. The console is seen to include a start pushbutton, an emergency off/on switch, a pilot light, and a four-digit read-out or display for each pump. Each digit of each read-out is composed of a conventional 7-segment alpha-numeric character.

Figure 2:
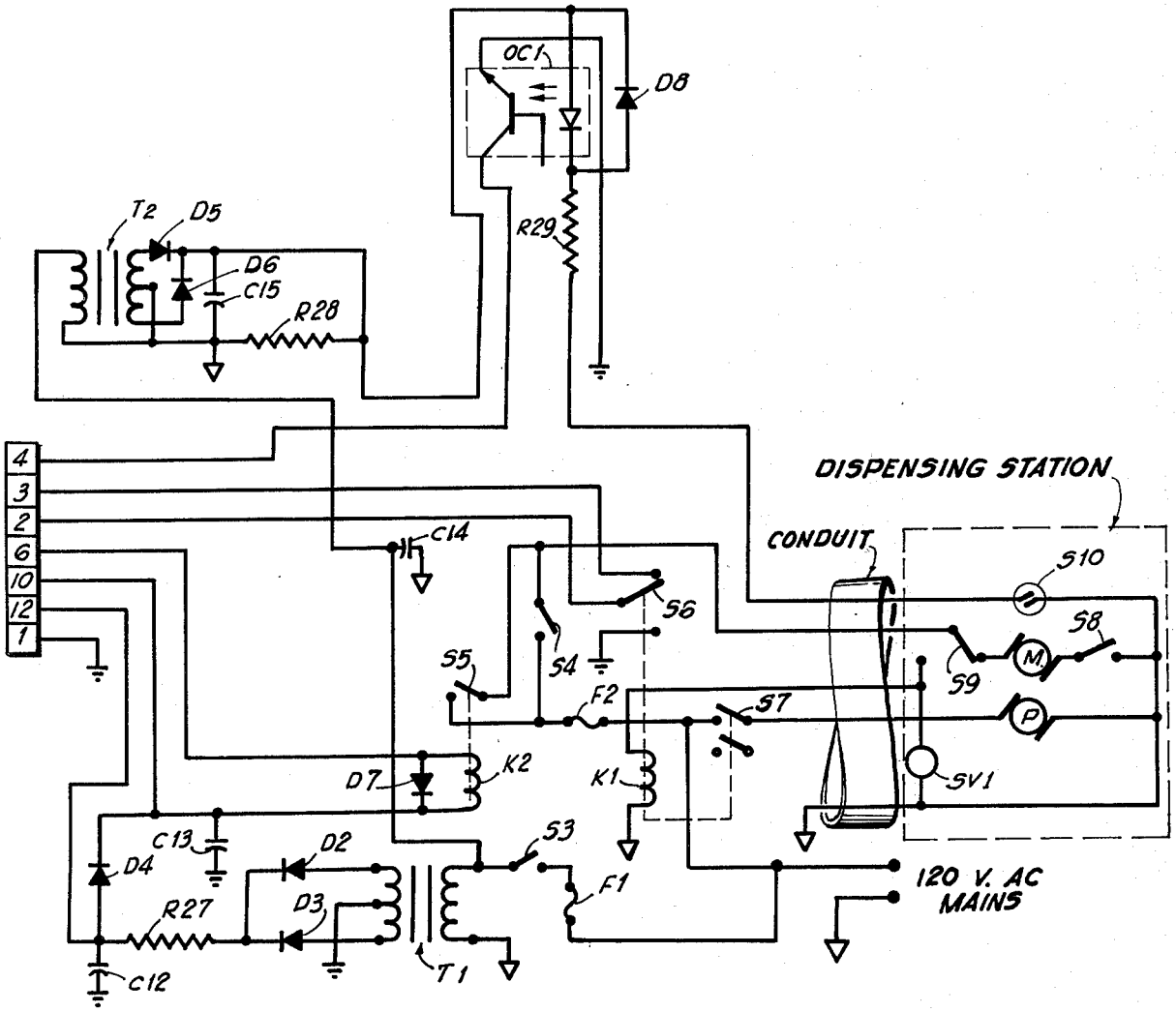
FIGS. 2, 3A and 3B are schematic diagrams of a remote control fluid dispensing system for a single pump fluid dispenser embodying principles of the present invention in a preferred form.

With reference next to FIG. 2 the remote control fluid dispensing system is seen to include circuitry at a pumping station for operating and metering one pump which circuitry is connected through a conduit to other circuitry all of which is located at a control station. The conduit typically extends from the pump under paved roadway to a station house where it terminates at an interconnection box mounted on a wall. Some of the illustrated circuitry is located within this box while other circuitry extends from the box, all within the area of the control station, to the control and meter console just described and to an AC voltage source.

The system circuitry at the dispensing station includes pulse generating means in the form of reed switch S10, a reset motor M for price and quantity indicia bearing wheels located at the dispenser, a pump P, and a fluid valve SV1. An unshown pump handle is also located at the dispensing station that is mechanically coupled with both a single throw switch S8 and a double throw switch S9.

With continued reference to FIG. 2 the pulse generating means switch S10 is seen to be connected through a current limiting resistor R29 to an optical coupler OC1 which includes a light emitting diode connected directly with resistor R29. A diode D8 is connected in parallel with the light emitting diode to protect it from noise. The optical coupler also includes a phototransistor having its emitter grounded and its collector connected with pin 4 of the circuit interconnection board shown at the top of FIG. 3B with corresponding pins shown in ganged blocked form in FIG. 2. The light emitting diode of the optical coupler is also connected with a conventional DC power supply for the pulse generating switch S10 that comprises a transformer T2, a pair of diodes D5 and D6, capacitor C15, and resistor R28. Another DC power supply for the system console is located in the interconnection box at the end of the conduit within the control station. This power supply is also conventional comprising diodes D2, D3, and D4, capacitors C12 and C13, resistor R27 and a transformer T1. Both transformers T1 and T2 are connectable through a fuse F1 and a switch S3 to a 120 volts AC power supply, and are connected through a noise protecting capacitor C14 to AC common.

With continued reference to FIG. 2 another terminal for the double throw switch S9 is seen to be connected to AC common through relay K1 for actuating a switch S7 that controls pump P. Relay K1 also actuates a double throw switch S6 for automatic reset operations. One terminal of this double throw switch is seen to be connected to pin 3 of the connection board while the other terminal is connected to DC common. The movable switch member is connected to pin 2 of the circuit board. Another relay K2 is coupled to pin 6 of the circuit board and to the DC power supply for the console with a protective diode D7 connected thereacross. K2 operates a switch S5 which is connected across a manual override switch S4 housed in the interconnection box to provide AC power to the S9 movable switch member from the AC mains through fuse F2.

Figure 3A:
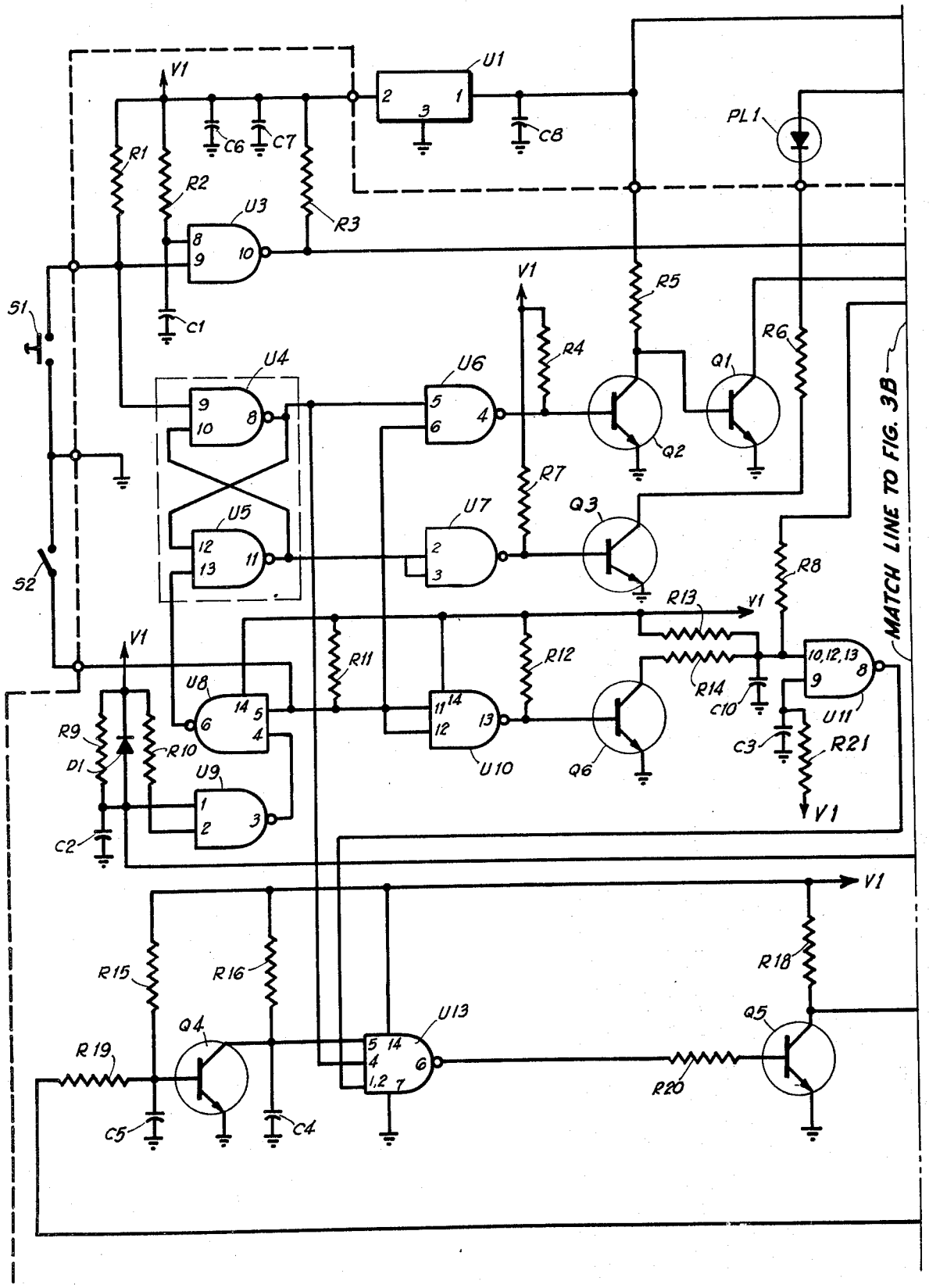
Figure 3B:
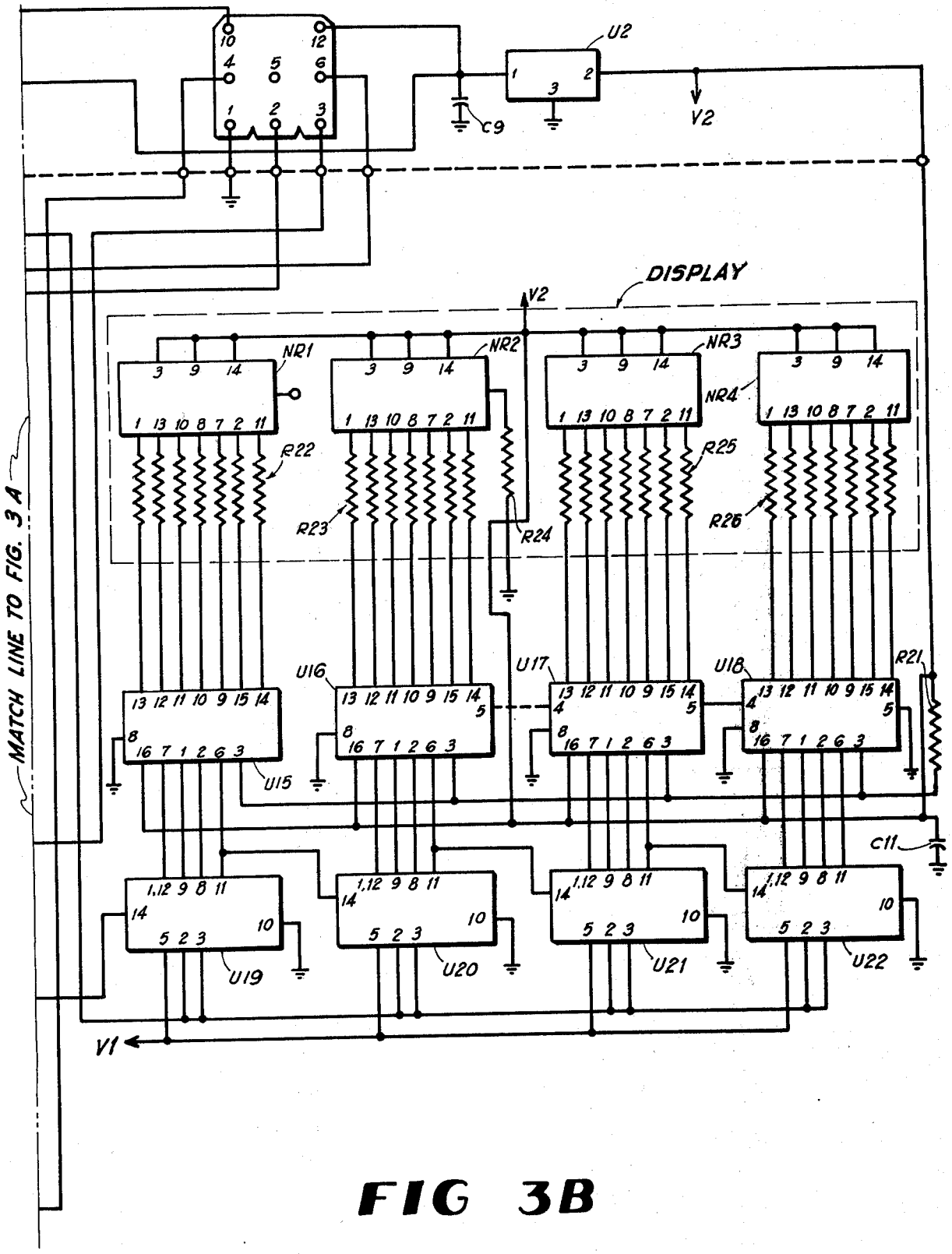

With reference next to FIG. 3B the console is seen to include a conventional BCD counter and a display having four, 7-segment alpha-numeric character numerical read-outs NR1, NR2, NR3, and NR4 which respectively serve to display cents, 10-cents, dollars, and 10-dollars. Pins 3, 9, and 14 of each read-out are connected in common and to voltage V2 while the other pins connected to each of the 7-segments are connected through current limiting resistors R22, R23, R25, and R26 respectively to decoder drivers U15, U16, U17, and U18. Pins 7, 1, 2 and 6 of each driver provide binary coded decimal input terminals that are connected to pins 1 and 12, 9, 8 and 11 respectively of decade counters U19, U20, U21, and U22. Pin 11 of each counter is also connected to pin 14 of the next successive counter in providing means for carrying over to the next digit. Pin 10 of each counter is seen to be grounded while pin 3 of each driver is connected through a pullup resistor R21 to a voltage regulator U2. A filter capacitor C11 by-passes terminal 2 of U2 to ground while a capacitor C9 by-passes terminal 1 of the voltage regulator U2 to ground.

With reference next to FIG. 3A a console pilot light PL1 is seen to be connected to pin 1 of voltage regulator U2 and to a transistor Q3 through current limiting resistor R6 which transistor has its base connected with the output of a NAND gate U7 and through a pullup resistor, R7 to V1. The input lines of U7 are connected to a flip-flop control memory comprising two NAND gates U4 and U5. A normally open, springbiased start switch S1 is connected between ground and pins 9 of NAND gates U3 and U4, the former having its output connected to the display counter. Input pin 8 of U3 is grounded through an automatic reset capacitor C1 and also to voltage V1 through a pullup resistor R3. Pin 9 is also seen to be connected to voltage V1 through a pullup resistor R1. Pin 2 of an integrated circuit voltage regulator U1 is also connected to V1 and is by-passed to ground through parallel filter capacitors C6 and C7. Pin 3 is grounded and pin 1 also by-passed to ground through a filter capacitor C8. Pin 1 here is also connected to a bias resistor R5 and to pin 10 of the connection board.

An emergency stop switch S2, that is normally oriented in an open position, connected between ground and input pin 5 of a NAND gate U8 having its output connected to input pin 13 of U5. Pin 14 of U8 is connected to voltage V1 while pin 4 is connected to the output of another NAND gate U9 having its input pin 1 by-passed to ground through noise filter capacitor C2 and input pin 2 connected through pullup resistor R10 to voltage V1. A diode D1 and another pullup voltage resistor R9 are connected in parallel between V1 and pin 1. The input pin 5 of U8 is connected to input pins 11 and 12 of another NAND gate U10. A pullup resistor R11 is connected across pins 5 and 14 of U8 and pullup resistor R12 is connected across pins 13 and 14 of U10. The gate of a transistor Q6 is coupled to the output of U10 while its emitter is grounded and its collector is connected through a current limiting resistor R14 to input pins 10, 12, and 13 of a NAND gate U11. Another pullup resistor R13 connects pins 10, 12 and 13 with V1 while a current limiting resistor R8 connects these pins with pin 2 of the connection board. The output pin 8 of the flip-flop memory NAND gate U4 is connected to input pin 5 of the NAND gate U6 while the output of this gate is coupled to the gate of transistor Q2 with pullup resistor R4 connected to V1. The collector of Q2 is connected to the gate of transistor Q1 which has its emitter grounded and its collector connected to pin 6 of the connection board. A bias resistor R5 connects the base of Q1 to pin 1 of U1.

With continued reference to FIG. 3A, a conventional noise filter is seen to be provided for the counter having a resistor R19 coupling the gate of a transistor Q4 with pin 4 in the connection board. A capacitor C5 couples the gate with ground while resistors R15 and R16 connect the transistor gate and collector respectively with V1. The transistor emitter is grounded while the collector is also connected to pin 5 of a Schmitt trigger U13 that shapes the filtered signal. An invertor is provided comprising a transistor Q5 having its gate connected by resistor R20 to the output of the Schmitt trigger, its emitter grounded, and its collector connected by resistor R18 to V1 and also to pin 14 of decade counter U19.

One workable set of values for components of the just described system are now presented in Table I.

TABLE I

| | | | | |
|---|---|---|---|---|
| C1 | 30 microfarads | | K1 | DPST relay 120 VAC coil |
| C2 | .1 | " | K2 | SPST relay 12 VDC coil |
| C3 | 10 | " | | |
| C4 | 5 | " | M | 120 Reset Motor in pump |
| C5 | 5 | " | | |
| C6 | .1 | " | P | 120/240 VAC Pump Motor |
| C7 | 30 | " | | |
| C8 | .22 | " | NR1 | Monsanto MAN 72 7-segment LED |
| C9 | .22 | " | NR2 | Monsanto MAN 72 7-segment LED |
| C10 | 30 | " | NR3 | Monsanto MAN 72 7-segment LED |
| C11 | .1 | " | NR4 | Monsanto MAN 72 7-segment LED |
| C12 | 4,000 | " | | |
| C13 | 39,000 | " | OCl | Optical Coupler Monsanto MC T-2E |
| C14 | .01 | " | | |
| C15 | 2,000 | " | Q1 | 2N697 |
| | | | Q2 | 2N2222 |
| D1 | IN4148 | | Q3 | 2N2222 |
| D2 | IN4721 | | Q4 | 2N2222 |
| D3 | IN4721 | | Q5 | 2N2222 |
| D4 | IN4721 | | Q6 | 2N2222 |
| D5 | IN4007 | | | |
| D6 | IN4007 | | R1 | 1,000 ohms |
| D7 | IN4007 | | R2 | 4,700 ohms |
| D8 | IN4007 | | R3 | 1,000 ohms |
| | | | R4 | 4,700 ohms |
| F1 | 1 ampere | | R5 | 1,800 ohms |
| F2 | 4 amperes | | R8 | 22 ohms |
| R9 | 4,700 ohms | | | |
| R10 | 1,000 ohms | | | |

TABLE I-continued

| | |
|---|---|
| R11 | 1,000 ohms |
| R12 | 2,200 ohms |
| R13 | 10,000 ohms |
| R14 | 22 ohms |
| R15 | 4,700 ohms |
| R16 | 4,700 ohms |
| R18 | 2,200 ohms |
| R20 | 4,700 ohms |
| R21 | 4,700 ohms |
| R22 | 220 ohms |
| R23 | 220 ohms |
| R24 | 220 ohms |
| R25 | 220 ohms |
| R26 | 220 ohms |
| R27 | 1 ohm |
| R28 | 150 ohms |
| R29 | 2,200 ohms nom. |
| S1 | SPST normally open, momentary |
| S2 | SPST lever type switch |
| S3 | SPST toggle switch |
| S4 | SPST toggle switch |
| S5 | SPST contacts on K2 |
| S6 | SPDT snap action switch, auxiliary contacts on K1 |
| S7 | DPST main contacts on K1 |
| S8 | SPST snap action switch |
| S9 | SPDT snap action switch |
| S10 | SPST reed switch in pump |
| T1 | 120 VAC primary, 12 VAC secondary |
| T2 | 120 VAC primary, 12 VAC secondary |
| U1 | LM309K integrated circuit regulator |
| U2 | LM309K integrated circuit regulator |
| U3 | 7401 NAND gate I.C. |
| U4 | 7400 NAND gate I.C. |
| U5 | 7400 NAND gate I.C. |
| U6 | 7401 NAND gate I.C. |
| U7 | 7401 NAND gate I.C. |
| U8 | 7400 NAND gate I.C. |
| U9 | 7400 NAND gate I.C. |
| U10 | 7401 NAND gate I.C. |
| U11 | Schmitt trigger I.C. 7413 |
| U13 | Schmitt trigger I.C. 7413 |
| U15 | 7447 decoder-driver |
| U16 | 7447 decoder-driver |
| U17 | 7447 decoder-driver |
| U18 | 7447 decoder-driver |
| U19 | 7490 decade counters |
| U20 | 7490 decade counters |
| U21 | 7490 decade counters |
| U22 | 7490 decade counters |
| V1 | 5 VDC |
| V2 | 5 VDC |

In operation when the start button S1 is momentarily depressed the output pin 10 of NAND gate U3 presents a reset signal to the decade counters. The momentary closure of switch S1 also serves to set the flip-flop with the output from pin 11 of U5 gating transistor Q3 which turns on the pilot light PL1. The output from pin 8 of gate U4 causes NAND gate U6 to turn off transistor Q2 which, in turn, gates transistor Q1. This transistor then energizes relay K2 closing switch S5. With switch S5 closed AC voltage is applied to switch S9. A customer may now manually operate the pump handle and switches S8 and S9 mechanically coupled therewith. When this occurs two things happen. Power is applied to motor M which turns the unshown volume and price wheels on the pump and also operates switch S9 once all the wheels are reset to a zero position and the reset motor M is turned off. With double throw switch S9 now in the unshown position fluid valve SV1 is turned on and power is applied to relay K1 which closes switch S7 applying power to pump P.

With the dispenser pump now energized fluid is driven from the dispenser. Simultaneously K1 actuates switch S6 which does two things. It turns on NAND gate U13 via NAND gate U11 thereby enabling the electronic counters and also discharges capacitor C10 in preparation for automatic reset.

With fluid now flowing from the dispenser the pulser switch S10, being geared to the unshown pump display wheels, commences to pulsate. It sends counting pulses to the optical coupler OC1 causing the photodiode to emit pulses of light which intermittently gate the phototransistor internal the optical coupler. Electrical pulses from the phototransistor are fed through the noise filter and then through the Schmitt trigger which shapes them. The resulting, substantially square wave pulses are then fed into the decade counters which energize the numerical read-outs in displaying the money value of dispensed fluid.

Once a dispensing operation is complete the customer may operate the unshown pump handle thereby returning switch S9 to its shown position de-energizing relay K1 and fluid valve SV1. The relay opens switch S7 turning off pump P. It also returns switch S6 to the position illustrated momentarily grounding pin 1 of NAND gate U9 until capacitor C10 charges. The output from pin 3 of NAND gate U9 through the gate of NAND gate U8 resets the flip-flop, turns off pilot light PL1, and discharges relay K2 removing power from pump switch S9.

We thus see that a remote control fluid dispenser system is provided having its pulser unit and pumping circuits electrically isolated from one another. Typical prior art, electromechanical systems can be converted to the just described system without the need for placing individual conduits between the dispensing and control stations or for otherwise changing the wiring coupling the two stations together. With the system installed the possibility of a potentially dangerous voltage appearing at the control and meter console is almost nil. And with electronic read-outs long term system reliability is provided.

It should be understood that the just described embodiment merely illustrates principles of the invention in a preferred form. Many modifications, deletions and additions may, of course, be made thereto without departure from the spirit and scope of the invention as set forth in the following claims.

What is claimed is:

1. A remote control fluid dispensing system comprising:

a fluid dispenser at a dispensing station;

electrical pump means at said dispensing station for pumping fluid from said dispenser;

pulse generating means at said dispensing station for generating DC pulses in metered response to the dispensing of fluid from said dispenser;

electrical to light energy transducer means and light to electrical energy transducer means electrically insulated from but optically coupled with said electrical to light energy transducer means at a control station;

electrical circuit means for coupling said pulse generating means with said electrical to light energy transducer means and for coupling said electrical pump means with a source of current at said control station;

display means at said control station coupled with said light to electrical energy transducer means for displaying metered dispensing of fluid information generated by said pulse generating means.

2. A remote control fluid dispensing system in accordance with claim 1 wherein said electrical to light energy transducer means comprises a photodiode and wherein said light to electrical energy transducer comprises a phototransistor.

3. A remote control fluid dispensing system in accordance with claim 1 wherein said display means comprises a set of electrically energizable segmented alphanumeric characters controlled by a set of binary coded decimal counters.

4. A remote control fluid dispensing system in accordance with claim 1 further comprising DC power supply means at said control station supplying DC power to said pulse generating means at said dispensing station.

5. A remote control fluid dispensing system in accordance with claim 4 further comprising power supply means at said control station for supplying DC power to said display means.

6. A remote control fluid dispensing system comprising a pump; DC pulse generating means for generating DC pulses metering the flow of fluid pumped by said pump; first circuit means for coupling said pump with a source of alternating current; a DC power supply; second circuit means including an optical coupler coupling said DC pulse generating means with said DC power supply and with said first circuit means; and display means coupled with said second circuit optical coupler for displaying metered dispensing of fluid information generated by said DC pulse generating means.

7. A remote control fluid dispensing system in accordance with claim 6 wherein said optical coupler comprises a photodiode coupled with said pulse generating means and a phototransistor coupled with said display means.

8. A remote control fluid dispensing system in accordance with claim 6 wherein said display means comprises electrically energizable segmented alphanumeric characters controlled by a set of binary coded decimal counters.

* * * * *